US006468954B2

(12) United States Patent
Levitt et al.

(10) Patent No.: US 6,468,954 B2
(45) **Date of Patent: *Oct. 22, 2002**

(54) BLOOD, COFFEE OR FRUIT JUICE STAIN REMOVER IN AN ALKALINE COMPOSITION

(75) Inventors: Mark Levitt, St. Paul, MN (US); Kim R. Smith, Woodbury, MN (US); Laurie Ehlers, Lucas, IA (US)

(73) Assignee: Ecolab Inc., St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/440,397

(22) Filed: Nov. 15, 1999

(65) Prior Publication Data

US 2001/0056055 A1 Dec. 27, 2001

Related U.S. Application Data

(63) Continuation-in-part of application No. 09/079,793, filed on May 15, 1998.

(51) Int. Cl.[7] ..... C11D 1/14; C11D 3/10; C11D 7/12

(52) U.S. Cl. ..... 510/284; 510/337; 510/348; 510/357; 510/363; 510/509; 8/137

(58) Field of Search ..... 8/137; 510/337, 510/348, 357, 358, 363, 283, 509, 284

(56) References Cited

U.S. PATENT DOCUMENTS

| | | | | | |
|---|---|---|---|---|---|
| 3,494,870 | A | | 2/1970 | Kersnar et al. | 252/152 |
| 3,935,129 | A | | 1/1976 | Jabalee | 252/525 |
| 4,048,121 | A | * | 9/1977 | Chang | 252/527 |
| 4,202,800 | A | | 5/1980 | Ciko et al. | 252/543 |
| 5,514,302 | A | * | 5/1996 | Brown | 252/545 |
| 5,707,948 | A | * | 1/1998 | Evers et al. | 510/217 |
| 5,736,494 | A | * | 4/1998 | Colurciello et al. | 510/278 |
| 5,932,527 | A | * | 8/1999 | Roselle et al. | 510/111 |
| 5,958,854 | A | * | 9/1999 | Laing et al. | 510/218 |
| 5,958,871 | A | * | 9/1999 | Clare | 510/507 |

FOREIGN PATENT DOCUMENTS

| | | |
|---|---|---|
| DE | 3344097 | 6/1984 |
| EP | 0 114 113 | 7/1984 |
| EP | 0 383 373 A2 | 8/1990 |
| GB | 2 042 580 A | 9/1980 |
| GB | 2 131 826 A | 6/1984 |
| GB | 2 137 882 A | 10/1984 |
| JP | 52-126408 | 10/1977 |
| WO | WO 97/03155 | 1/1997 |

OTHER PUBLICATIONS

Liss, R. L. et al., "Enzymes in detergents", *J. Amer. Oil Chem. Soc.* (1969), 46(10):507–510.

Neher, D. et al., "Interaction between blood and oxygenating bleaching agents and problems involving enzyme–containing washing agents", *Fette, Seifen, Anstrichm.* (1970), 72(3):192–9 (Abstract only).

Oldenroth, O., "Action of enzymic prewashing agents", *Fette, Seifen, Anstrichm.* (1968), 70(1): 24–9 (Abstract only).

Vaeck, S. V. et al., "A micro wash test for the determination of enxyme performance", *Fette, Seifen, Anstrichm.* (1970), 72(7):573–9.

* cited by examiner

*Primary Examiner*—Gregory Delcotto
(74) *Attorney, Agent, or Firm*—Merchant & Gould P.C.

(57) ABSTRACT

A blood, coffee or fruit juice removing cleaning composition, and methods for using such, which may take the form of a detergent additive or pre-spotter, generally including an amount of carbonate source effective to remove blood, coffee or fruit juice from textiles. In other preferred forms the compositions disclosed herein may include surfactants.

22 Claims, No Drawings

BLOOD, COFFEE OR FRUIT JUICE STAIN REMOVER IN AN ALKALINE COMPOSITION

This application is a continuation-in-part of Smith et al., U.S. patent application Ser. No. 09/079,793 filed May 15, 1998, allowed which is expressly incorporated by reference herein.

FIELD OF THE INVENTOPN

This invention relates to compositions and methods for removal of blood, fruit juice or coffee stains from textiles. More specifically, the invention relates to aqueous inorganic salt-surfactant blends and methods of using these composition for the removal of blood, coffee or fruit juice stains from textiles including carpeting and natural and synthetic fabrics.

BACKGROUND OF THE INVENTION

The routine soiling of clothing, uniforms, carpeting, and other textiles is common in many industries. In most instances, fabrics and carpeting soiled in the course of professional service can be laundered and cleaned, effectively returning the fabric or carpeting to a condition suitable for use. As one might suspect, certain types of soils are more difficult to remove from fabric and carpeting than others.

Soiling of textiles resulting from contact with mammalian blood can be some of the most resistant to cleaning and laundering. Blood is generally considered a fluid connective tissue comprising plasma and cells which circulates within vessels in mammalian bodies. Of the many constituents of mammalian blood, certain elements such as, for example, hemoglobin and iron may contribute to the difficulty in removing blood stains from fabrics. As the blood dries on the fabric, it becomes a hydrophobic, protein-based soil that forms a crusty surface that is difficult to disrupt. Colored beverages such as soft drinks, tea and coffee present serious staining problems to textiles. These colored beverages are commonly acid dyes which cause severe staining. Coffee stains are very difficult to remove from synthetic fibers and are particularly unsightly due to their dark brown color.

In the past textiles soiled with blood were cleaned with a highly alkaline solution or a solution containing enzymes and/or chelating agents obtained from complex detergent formulations. However, the use of caustic alkaline solutions, for example in the laundering of clothes, uniforms, and other fabrics, requires the application of a large volume of rinse water to avoid deterioration of the fabric and burning of any person who may come into contact with the fabric. In turn, the rinse water resulting from alkaline cleaning methods creates environmental concerns as the cleaning solutions must be neutralized and disposed.

The use of solutions containing enzymes and/or chelating agents for the removal of blood from textiles also caused problems. Often such cleaning solutions left behind a sticky residue which led to additional soiling. In order to avoid leaving behind a sticky residue extensive rinsing was necessary. The need for such extensive rinsing results in additional work and, in some cases, the need for additional equipment. Complex formulations are also expensive to formulate and process.

A number of cleaning solutions have been proposed in the past for the removal of stains from textiles. For example, volatile dry-cleaning fluids have been utilized, but result in only marginal success with respect to water-soluble stains. There are also environmental concerns associated with the use and disposal of such dry-cleaning solutions. Aqueous compositions containing surfactants and/or enzymes have been utilized, but such compositions have not been found particularly effective against blood and especially coffee stains. These aqueous enzymatic compositions also lack shelf stability. Also, it is often the case that a specific cleaner must be used for a particular type of stain. Alkaline or enzymatic cleaners containing a chelating agent are usually used for blood while acidic cleaners, such as acetic acid, are used for coffee.

We have been able to formulate effective materials without a chelator, solvent, organic base, acid source, or other additions.

The use of carbonate in cleaning composition is known in the art. For example, U.S. Pat. No. 5,977,047 discloses laundry detergents compositions including a carbonate builder along with a surfactant and a carboxcyclic polymer. Additionally U.S. Pat. No. 3,957,695 discloses a detergent composition including sodium carbonate as a detergent builder, calcium carbonate as a precipitation inhibitor, and a detergent active compound. Cleaning composition including carbonate, enzymes and chelating agents is also known. U.S. Pat. No. 3,858,854 discloses a detergent composition including a surfactant or mixture of surfactants, a carbonate builder, and polymeric beads including an enzyme. Typically, the use of carbonate in such cleaning compositions is as a builder to supplement and enhance the cleaning effect of an active surfactant present in the composition. Carbonate builders improve the cleaning power of the formulated composition by the sequestration or precipitation of hardness causing metal ions such as calcium, reduction of critical micelle concentration, and by enhancing various properties of the active detergent, such as emulsification of soil particles and foaming and sudsing characteristics. The use of carbonate builders in detergent compositions does often result in the problem of calcium carbonate precipitation and textile encrustation due to the deposition of calcium carbonate.

As a result, there is still a need for simple, stable laundry and carpet cleaning compositions and methods. These two part (carbonate/surfactant) formulae can effectively remove both beverage, including for example, coffee, and blood stains from textiles while not leaving a tacky residue requiring extensive rinsing steps or impairing the color or integrity of the textile with out substantive formulations.

SUMMARY OF THE INVENTION

Generally, the present invention relates to aqueous carbonate surfactant compositions for the removal of blood, coffee or fruit juice from textiles. One embodiment is a method of removing blood, coffee or fruit juice from textiles comprising the step of applying an aqueous cleaning composition to the textile comprising from about 0.1 wt-% to 3 wt-% carbonate source, an effective amount, from about 0 wt-%, up to 0.2 wt-% of an ionic or nonionic surfactant, and a balance of water.

Another embodiment of the present invention is an aqueous cleaning composition comprising an amount of a carbonate compound effective to remove blood, coffee or fruit juice from textiles and an ionic or nonionic surfactant where the pH of the composition is from about 9 to about 11.

Yet another embodiment is a pre-spotter composition and methods for using the same for the removal of blood, coffee or fruit juice satins from textiles. The composition comprising an amount of a carbonate compound effective to remove blood, coffee or fruit juice from textiles and an ionic or nonionic surfactant, where the pH of the composition is from about 9 to about 11.

The invention has various aspects which allow removal of blood, coffee or fruit juice stains from natural and synthetic textiles. The invention allows removal of blood, coffee or fruit juice stains from textiles without the use of separate alkaline or enzymatic cleaners for blood stains and acidic cleaners for coffee stains. Further, the compositions and methods of the invention do not have shelf-life limitations and do not leave tacky deposits requiring extensive rinsing.

Representative textiles which may be treated by the compositions and methods of the invention include those derived from natural and synthetic fibers including celluloses, acrylics, olefins, acetates, aramids, nylons, polyesters, segmented polyurethanes (spandex), regenerated proteins (azlon), polyphenylene sulfides, and carbon/graphite fibers as well as inorganic fibers based on glass, metal, or ceramic constituents. These representative textiles may be incorporated into a variety of articles including, for example, clothing, uniforms, coverings, window treatments and carpeting We have discovered that aqueous solutions of carbonate can be formulated to be a very effective means of removing blood, coffee or fruit juice stains from textiles without the need of chelating, enzymatic, or acidic components. These carbonate compositions are not only able to remove blood, coffee or fruit juice stains from textiles with a single formulation, but are also free of shelf-life and residue problems associated with past cleaners. Additionally, the aqueous carbonate composition of the present invention dries to a powder which can be easily removed, for example, by vacuum, without the requirement of additional rinsing steps.

The carbonate cleaning compositions of the present invention use a carbonate source as the active cleaning agent. The main purpose of the carbonate source is not to act as a builder which enhances the cleaning effect of an active surfactant present in the composition. The carbonate cleaning compositions of the present invention effectively remove blood, coffee or fruit juice stains without the requirement of chelating agents, enzymes or surfactants. Any of the above methods or compositions can be embodied in a formulation substantially free of another surfactant or another source of alkalinity.

The above summary of the present invention is not intended to describe each disclosed embodiment or every implementation of the present invention. The detailed description which follows more particularly exemplifies these embodiments.

Detailed Description of the Preferred Embodiment

The present invention is believed to be applicable to the removal of blood, coffee or fruit juice stains from textiles. In particular, the present invention is directed to compositions and methods for the removal of blood, coffee or fruit juice stains from textiles. Included in the invention are spot removers and pre-spotters. The constituents of these systems may include sources of carbonate and surfactants. While the present invention is not so limited, an appreciation of various aspects of the invention will be gained through a discussion of the examples provided below.

The Carbonate Compound

The composition of the present invention generally include a carbonate source as the cleaning agent. Useful inorganic carbonate sources include alkali and alkali earth metal carbonate ($CO_3^{2-}$), hydrogen carbonate ($HCO_3^-$), and sesquicarbonate salts. Such carbonate sources include, for example, sodium carbonate, potassium carbonate, lithium carbonate, calcium carbonate, sodium hydrogen carbonate (sodium bicarbonate), potassium hydrogen carbonate and the like. Preferably, potassium or sodium carbonates or hydrogen carbonates are preferred. Most preferably, the carbonate source is a combination of sodium carbonate and sodium hydrogen carbonate at a wt/wt ratio of about 1:0 to 0.5:1. The concentration of the carbonate generally ranges from about 0.1 wt-% to 3 wt-%, based on the total weight of the cleaning composition. Preferably the concentration of the carbonate is from about 0.8 wt % to 1 wt %. Typically, the carbonate source includes a mixture of sodium hydrogen carbonate and sodium carbonate where the concentration of sodium hydrogen carbonate is from about 0.0 wt-% to 1.5 wt-% and the concentration of sodium carbonate is from about 0.1 wt-% to 3 wt-%, based on the total weight of the cleaning composition. Preferably, the concentration of sodium hydrogen carbonate is from about 0.4 wt-% to 0.5 wt-% and the concentration of sodium carbonate is from about 0.35 wt-% to 0.45 wt-%, based on the total weight of the cleaning composition The concentration of carbonate source in the cleaning composition is such so as to provide a resulting pH that effectively removes blood, coffee or fruit juice stains yet does not damage the textile fibers. Cleaning compositions for fifth generation nylon textiles, for example, which exceed a pH of 10 can cause degradation of stain blockers or preventers which are applied to the textile, rendering them ineffective. Preferably cleaning composition of the present invention have a carbonate concentration such that the resulting pH of the composition is from about 9 to about 11. Most preferably the pH of the cleaning composition is about 10.

Surfactants

The use of surfactants in the compositions of the invention improves wetting of the stain loosens staining material from the textile and enhances the transfer of this material into the cleaning system so that this material may be removed. Both nonionic amphoteric and anionic surfactants can be utilized in the present invention but are not required.

Nonionic surfactants useful in this invention include, for example, alkyl phenol ethoxylates, dialkylphenol ethoxylates, alcohol ethoxylates, and ethylene oxide/propylene oxide block copolymers such as the PLURONIC™ surfactants commercially available from BASF Wyandotte, glycol esters, polyethylene glycol esters, sorbitan esters, polyoxyethylene sorbitan esters, surfactants which comprise alkyl ethylene oxide compounds, alkyl propylene oxide compounds, as well as mixtures thereof, and alkyl ethylene oxide propylene oxide compounds where the ethylene oxide-propylene oxide moiety is either in heteric or block formation. Further useful nonionic surfactants are those having any mixture or combination of ethylene oxide-propylene oxide moieties linked to an alkyl chain where the ethylene oxide and propylene oxide moieties may be in any randomized or ordered pattern and of any specific length.

Amphoteric surfactants useful in the present invention include, for example, those from the classes of glycinates, propionoates, betaines, and amine oxides.

Anionic surfactants useful in the present invention include, for example, sodium lauryl sulfate, sodium dioctyl sulfosuccinate, calcium dioctyl sulfosuccinate, sodium dodecyl benzene sulfonate, sodium polyoxyethylene alkyl aryl sulfonate, ammonium polyoxyethylene alkyl aryl sulfonate, Disodium Laureth-3 Sulfosuccinate, Sodium Cetyl Glutamate, Sodium Undecenyl Glutamate, Sodium Lauroyl Glutamate, sodium diisooctyl sulphosuccinate, tetrasodium N-(1,2-dicarboxyethyl) N-alkyl (C18) sulfocuccinamate and sodium alkyl sarcosinate.

Surfactants based on silicone or fluorine hydrophobes are also expected to provide the desired wetting and surfactant properties. These surfactants could also include anionic, amphoteric and nonionic types.

Preferred surfactants are anionic surfactants. The most preferred surfactant is sodium lauryl sulfate. Typically, the compositions of the present invention include an amount of surfactant effective to remove blood, coffee or fruit juice from textiles. Preferably, the composition of the present invention include an effective amount up to about 0.2 wt % surfactant. Most preferably, the compositions include from about 0.1 wt % to 0.2 wt % surfactant.

Formulation and Use of Cleaning Compositions

In formulation and use, the compositions of the invention can be used independently, for example, as a spot remover or as a pre-spotter followed by an additional cleaning method. One further aspect of the invention is detergent compositions containing the coffee or blood stain removing compositions of the invention. For example, the compositions of the present invention can be used autonomously in the prewash steps of industrial washing applications. The detergent compositions of the invention may also contain additional detergent components. The precise nature of these additional components, and levels of incorporation thereof will depend on the physical form of the composition, and the precise nature of the washing operation for which it is to be used.

The compositions of the invention may contain one or more additional detergent components selected from additional surfactants, additional bleaches, bleach catalysts, alkalinity systems, builders, organic polymeric compounds, additional enzymes, suds suppressers, lime soap dispersants, soil suspension and anti-redeposition agents, corrosion inhibitors and chelating agents.

As noted above, exemplary compositions include detergent pre-spotters and additives. The detergent pre-spotter may be used autonomously without mixing in a detergent.

The general composition for a pre-spotter includes an amount of carbonate source effective to remove blood, coffee or fruit juice from textiles, and an effective soil removing amount of surfactant. A preferred pre-spotter composition includes, for example, from about 0.1 wt % to 3 wt % carbonate source, from about 0 wt % to about 0.2 wt % surfactant and a balance of water. Most preferably a pre-spotter composition includes, for example, from about 0.4 to 0.5 wt-% of sodium hydrogen carbonate, from about 0.35 to 0.45 wt-% of sodium carbonate, from about 0.1 to 0.2 wt-% of sodium lauryl sulfate and a balance of water.

The treatment process for the pre-spotter entails wetting the soiled textile with the pre-spotter followed by a post treatment step. Typical post treatment steps include, for example, blotting the loosened spot with an absorbent cloth or towel, a solvent rinse, a solvent rinse followed by vacuum extraction, dry vacuum extraction, or normal wash operation.

EXAMPLES

The following are non-limiting illustration of the invention intended to exemplify some of the advantages of the invention.

Example 1

Textile swatches made of cotton or cotton polyester blend (i.e. clothing or carpet) soiled with dried blood were treated with equal amounts of various alkaline solutions. The composition of the cleaning solutions are stated in the table below. The textile samples were then agitated followed by a water extraction. The samples were each assessed and the cleaners scored with respect to their ability to remove blood stains.

The results obtained showed that the carbonate based cleaner is superior in blood removal to highly chelating solutions, such as ethylenediaminetetraacetic acid (EDTA) and N-(2-hydroxyethyl)ethylenediaminetriacetic (HEDTA), which would be expected to provide equal or more effective blood removal.

| Low Blood Removal | Increased Blood Removal |
|---|---|
| 1% aqueous solution of EDTA, pH 10.1 | 1% aqueous solution of sodium sesquicarbonate, pH 10.1 |
| 1% aqueous solution of HEDTA, pH 10.1 | |

Example 2

The following soils were applied to textiles of cotton or cotton polyester blend (i.e. clothing or carpet) in moderate quantities and exposed to the sun for approximately six hours. The dried stains were then allowed to stand undisturbed at room temperature for an additional 62 hours. Equal amounts of a cleaning solution were then applied to each stain. The textile samples were then agitated followed by a water extraction. The samples were each assessed for stain removal and scored as follows:

1=excellent removal

2=moderate removal

3=slight removal

4=no removal

The various cleaning solutions included the carbonate cleaning composition of the present invention (e.g. 0.44% sodium bicarbonate, 0.40% sodium carbonate, 0.15% sodium lauryl sulfate, and 99.01% water); commercial general purpose cleaner, commercial solvent cleaner; commercial 5% aqueous hydrogen peroxide cleaner, and a commercial acid cleaner.

The results obtained showed that the carbonate spot remover was equal or superior to the commercial cleaners in the removal of acid based type stains such as coffee, tea and juice.

| | General Purpose | Solvent Spotter | $H_2O_2$ | Acid Spotter | Carbonate Spotter |
|---|---|---|---|---|---|
| Coffee | 2 | 3 | 1.5 | 2 | 2 |
| Tea | 3 | 3 | 1 | 3 | 2 |
| Orange juice | 1.5 | 4 | 1 | 1 | 1 |
| Grape juice | 1.5 | 2 | 1 | 2 | 1.5 |
| Red wine | 3 | 3 | 1.5 | 3 | 1.5 |

Example 3

The following soils were applied to textiles of unprotected nylon carpet in moderate quantities and allowed to dry.

Equal amounts of a cleaning solution were then applied to each stain and then agitated. The samples were each assessed for stain removal and scored as follows:

1=excellent removal

2=moderate removal

3=slight removal

4=no removal

The various cleaning solutions included the following commercial stain removers: Ramsey general purpose stain remover (Ramsey Co., Marlbourough, Mass.), SC Johnson tannin stain remover, SC Johnson protein spotter, SC Johnson general purpose stain remover (SC Johnson Wax, Racine, Wisc.).

The results obtained showed that the various commercial cleaners, including the enzymatic protein stain remover, low scores in the removal of acid based type stains such as coffee, tea and juice. In comparison to the carbonate based cleaner in Example 2, the commercial cleaners, including the enzymatic protein stain remover, were inferior in the removal of the same acid based type stains such as coffee, tea and juice.

| | Ramsey general purpose stain remover | SC Johnson tannin stain remover | SC Johnson general purpose stain remover | SC Johnson protein spotter |
|---|---|---|---|---|
| Coffee | 3 | 3 | 2 | 3 |
| Tea | N/A | N/A | N/A | N/A |
| Orange juice | 3 | 3 | 3 | 3 |
| Grape juice | 1 | 3 | 1 | 1 |
| Red wine | 1 | 2 | 1 | 1 |

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A method of removing blood, coffee or fruit juice stains from textiles, said method comprising the step of applying an aqueous cleaning composition to a textile containing stain from at least one of blood, coffee, and fruit juice, said aqueous cleaning composition comprising from about 0.1 to 3 wt-% of a carbonate source, from about 0.1 wt-% to 0.2 wt-% of an ionic or nonionic surfactant, and a balance of water.

2. The method of claim 1, wherein said carbonate source is selected from the group consisting of alkali and alkali earth metal salts of hydrogen carbonate, carbonate, sesquicarbonate and mixtures thereof.

3. The method of claim 1, wherein said carbonate source is selected from the group consisting of sodium hydrogen carbonate, sodium carbonate and mixtures thereof.

4. The method of claim 1, wherein said ionic surfactant is an anionic surfactant.

5. The method of claim 4, wherein the anionic surfactant is sodium lauryl sulfate.

6. The method of claim 1, wherein the pH of said aqueous cleaning composition is from about 9 to 11.

7. The method of claim 1, further comprising the step of rinsing the textile.

8. An aqueous cleaning composition consisting essentially of:

a) from about 0.1 wt-% to 3 wt-% carbonate source; and b) about 0.1 wt-% to about 0.2 wt-% sodium lauryl sulfate.

9. The composition of claim 8, wherein said carbonate source is selected from the group consisting of alkaline metal salts of hydrogen carbonate, carbonate and mixtures thereof.

10. The composition of claim 8, wherein said carbonate source is selected from the group consisting of sodium hydrogen carbonate, sodium carbonate and mixtures thereof.

11. The composition of claim 8, wherein the pH of said aqueous cleaning composition is from about 9 to 11.

12. An aqueous cleaning composition consisting essentially of:

a) from about 0.8 to 1 wt-% carbonate source;

b) from about 0.1 wt-% to 0.2 wt-% of sodium lauryl sulfate; and c) a balance of water.

13. The composition of claim 12, wherein said carbonate source is selected from the group consisting of sodium hydrogen carbonate, sodium carbonate and mixtures thereof.

14. The composition of claim 12, wherein the pH of said aqueous cleaning composition is from about 9 to 11.

15. An aqueous cleaning composition consisting essentially of:

a) from about 0.4 to 0.5 wt-% of sodium hydrogen carbonate;

b) from about 0.35 to 0.45 wt-% of sodium carbonate;

c) from about 0.10 to 0.20 wt-% of sodium lauryl sulfate; and d) a balance of water.

16. The composition of claim 15, wherein the pH of said aqueous cleaning composition is from about 9 to 11.

17. A pre-spotter composition for removal of blood, coffee or fruit juice stains from textiles, consisting essentially of:

a) from about 0.1 to 3 wt-% carbonate source; and b) about 0.1 wt-% to about 0.2 wt-% sodium lauryl sulfate.

18. The composition of claim 17, wherein said carbonate source is selected from the group consisting of sodium hydrogen carbonate, sodium carbonate and mixtures thereof.

19. The composition of claim 17, wherein the pH of said aqueous cleaning composition is from about 9 to 11.

20. A pre-spotter composition for removal of blood, coffee or fruit juice stains from textiles, consisting essentially of:

a) from about 0.80 to 1 wt-% carbonate source;

b) from about 0.1 wt-% to 0.2 wt-% of sodium lauryl sulfate; and c) a balance of water.

21. A pre-spotter composition for removal of blood, coffee or fruit juice stains from textiles, consisting essentially of:

a) from about 0.4 to 0.5 wt-% of sodium hydrogen carbonate;

b) from about 0.35 to 0.45 wt-% of sodium carbonate;

c) from about 0.10 to 0.20 wt-% of sodium lauryl sulfate; and d) a balance of water.

22. A method of using the pre-spotter composition of claim 21, comprising the step of applying the pre-spotter composition to the fabric.

* * * * *